United States Patent [19]

Sweeney, Sr. et al.

[11] Patent Number: 4,842,266

[45] Date of Patent: Jun. 27, 1989

[54] PHYSICAL EXERCISE APPARATUS HAVING MOTIVATIONAL DISPLAY

[76] Inventors: James S. Sweeney, Sr.; James S. Sweeney, Jr., both of 2775 Temple Hills Dr., Laguna Beach, Calif. 92651

[21] Appl. No.: 900,720

[22] Filed: Aug. 27, 1986

[51] Int. Cl.[4] ..... A63B 23/06

[52] U.S. Cl. ..... 272/69; 272/100; 272/DIG. 9

[58] Field of Search ..... 272/69, 100, DIG. 9; 340/323 R

[56] References Cited

U.S. PATENT DOCUMENTS

| | | | |
|---|---|---|---|
| 2,631,853 | 3/1953 | Haynes et al. . | |
| 3,169,022 | 2/1965 | Kretsinger . | |
| 3,454,942 | 7/1969 | Chamberlin et al. . | |
| 3,518,985 | 7/1970 | Quinton . | |
| 3,675,640 | 7/1972 | Gatts | 272/69 |
| 3,711,812 | 1/1973 | Cherry | 272/69 |
| 3,826,491 | 7/1974 | Elder | 272/69 |
| 3,834,702 | 9/1974 | Bliss | 272/69 |
| 3,869,812 | 3/1975 | Arakelian et al. | 35/22 R |
| 3,984,666 | 10/1976 | Barron | 235/151.3 |
| 4,126,956 | 8/1980 | Yamamura et al. | 272/70 |
| 4,169,588 | 10/1979 | Miffitt et al. | 272/70 |
| 4,278,095 | 7/1981 | Lapeyre | 128/689 |
| 4,321,673 | 3/1982 | Hawwass et al. | 364/412 |
| 4,322,080 | 3/1982 | Pennington | 276/86 B |
| 4,358,105 | 11/1982 | Sweeney | 272/73 |
| 4,378,111 | 3/1983 | Tsuchida et al. | 272/73 |
| 4,416,293 | 11/1983 | Anderson et al. | 128/782 |
| 4,443,008 | 4/1984 | Shimano | 272/73 |
| 4,643,418 | 2/1987 | Bart | 272/69 |
| 4,708,337 | 11/1987 | Shyu | 272/69 |

*Primary Examiner*—Leo P. Picard

*Attorney, Agent, or Firm*—Thomas J. Plante

[57] ABSTRACT

A running/walking machine, or treadmill, is disclosed which has an automatically controlled speed-varying electric motor and an automatically controlled elevation-varying electric motor. The commands are entered in a display panel having a microprocessor which communicates with the motor controlling circuitry. The display panel has feedback information in a pictorial display, controlled by the microprocessor, in which an oval track simulating a running track displays both the current position of the user in moving around the track and the percentage of completion of a pre-established goal. The track has a multiplicity of segments, each represented by an LED, and each constituting a given fraction of the distance represented by the complete track. A lighted LED, which changes as the user progresses, indicates the current position of the user; and a string of LEDs behind the LED indicates the portion of the total program which has been completed. At completion of the program all the LEDs in the track are turned on.

20 Claims, 6 Drawing Sheets

PHYSICAL EXERCISE APPARATUS HAVING MOTIVATIONAL DISPLAY

BACKGROUND OF THE INVENTION

This invention relates to physical exercise apparatus, of the type which is used to improve the physical condition of the user. It is intended primarily for use in exercise spas and in private residences, rather than in medical facilities.

The apparatus disclosed is a running (or walking) machine, or treadmill. However, some of its novel features could be applied to other exercise apparatus, such as cycling machines or rowing machines.

One of the primary concerns in the field of voluntary exercising is the problem of motivation. The selfdiscipline required by the person doing the exercising may not be adequate to sustain a consistent and repeated effort, which is needed for effective fitness training.

It is, therefore, considered highly desirable to provide a sense of accomplishment and progress toward a preselected goal, in order to hold the interest of the user. The use of a visual display is generally a major aspect of exercise motivation.

A fundamental requirement of a running machine, or treadmill, is a motor-driven moving surface on which the user walks or runs. Varying the motor speed requires the user to vary his/her speed in order to stay in position on the machine.

Many exercise machines are user-driven, i.e., they only operate due to the work exerted by the user, e.g., cycling equipment, rowing equipment, lifting equipment, etc. Running machines have a different function, in that their speed is determined by the selected motor speed, and the user is required to maintain the speed determined by the motor. Controls are provided to permit the user to vary the motor speed; but the selected speed, not the user's effort, controls the running speed.

In addition to speed variation, many running machines provide for change in elevation. In other words, the user can run on a horizontal surface, or an inclined surface, which simulates running (or walking) uphill. Varying the elevation, in some cases, requires manual adjustment prior to use.

The apparatus of the present invention provides for changes of both speed and elevation; and these changes may be made either automatically under CPU control, or established by user intervention. In either case, the control is accomplished through the electronic control system.

An important aspect of the apparatus of this invention is its visual display, which incorporates significant motivating features.

SUMMARY OF THE INVENTION

The present invention provides a significant motivational feature, in the form of a closed loop visual indicator, which moves in such a way as to represent both the distance traversed, and the progress of the user toward the preset goal. The closed loop preferably is in the form of an oval, which simulates the shape of a track, and is, therefore, particularly appropriate for running exercise.

The visual indicator, which may take the form of a plurality of separately actuated units of lit/unlit elements, such as LEDs, shows both the position of the runner as he/she progresses around the track, and the percentage of progress toward the total number of laps which was preset as the goal. The latter indication is provided by gradually filling the track with the number of simultaneously actuated visual elements. In other words, as the exercise progresses, a string of elements lights up, in which the leading element represents the current position of the user, and the length of the string represents the percentage of completion of the preselected exercise goal. When the track fills up with lighted elements, the goal has been reached, i.e., the exercise program has been completed.

The present invention also provides various options for the user's selection, and permits overriding of previous selections at will. A number of programs, or protocols, have been pre-designed, having various degrees of difficulty, both in the length of the program and in the maximum degree of elevation during the program. The user may select one of these programs, may choose independent user-selected values, or may select values for "interval training". The display includes a visual representation of the relative difficulties of pre-designed programs, and of the percent grade of elevation, in addition to the oval track representing current position and percentage of completion.

DETAILED DESCRIPTION OF SPECIFIC EMBODIMENTS

Figure 1:
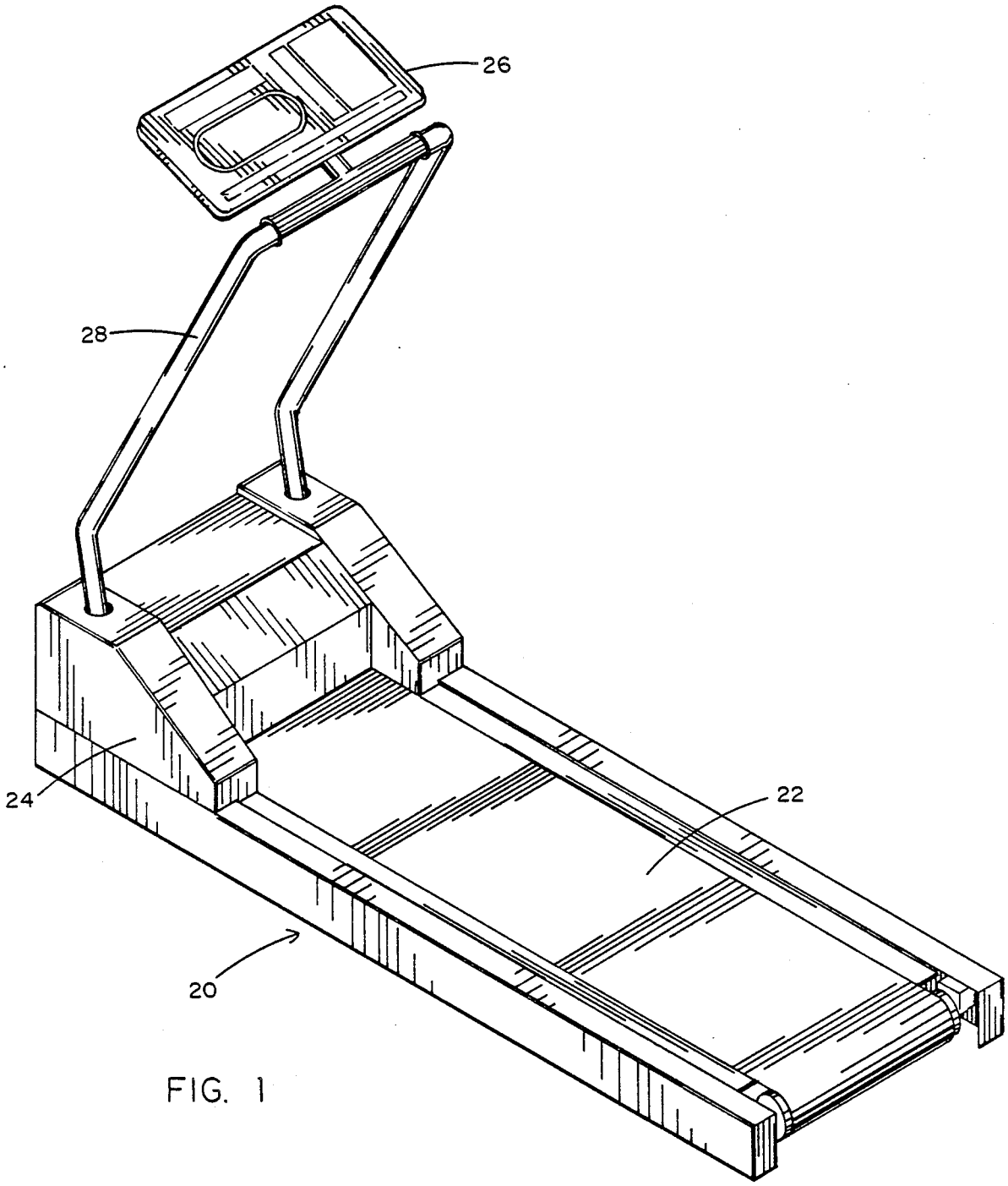
FIG. 1 is an isometric view showing a running/walking machine of the type provided by the present invention.

As shown in FIG. 1, a running machine, or treadmill, 20 has a walking/running surface 22, which is provided by an endless belt. The belt extends around two cylindrical end rollers (not shown), one of which is driven by a motor, preferably a DC electric motor, which is housed in an enclosure 24 located at the front of the apparatus. As the upper surface of the belt moves toward the rear of the apparatus, the user's pace is determined by the speed of the belt motion. A suitable non-moving platform (not shown), which is referred to as a "slider bed", underlies the portion of the belt on which the user is moving. The running platform may have dimensions of approximately 4 to 5 feet length and 1.5 feet width.

The speed of motion of surface 22 may be varied by changing the motor speed. Another variable is the elevation, which may be changed from a horizontal level to a desired degree of inclination by raising the front end of the surface 22, so that the user has the experience of moving up an incline, or hill.

A separate electric motor (i.e., not the belt driving motor) is used to raise or lower the front end elevation. This change of elevation may be effected by rotating round nuts on vertical, non-rotating lead screws. Two such vertical screws, one at each side under the front end of the platform, will suffice to raise and lower the "grade", or degree of inclination, of the moving surface 22. The nuts are rotated by a second electric motor, which simultaneously drives the nuts on both vertical screws. The driving force may be conveyed by cog-belts, driven by motor-rotated gears, and press fitted on the peripheries of the respective nuts.

Figure 2:
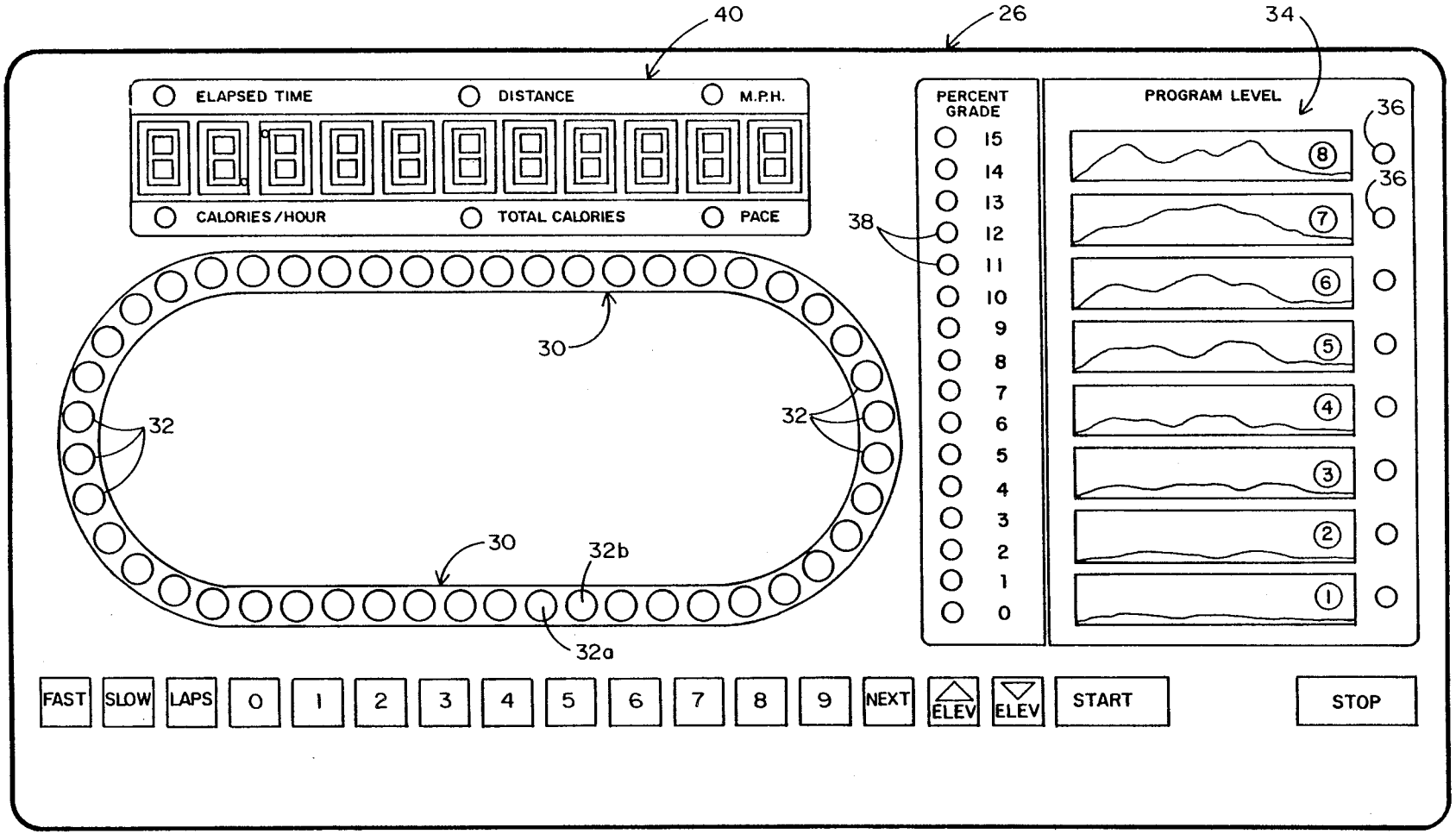
FIGS. 2 and 3 are closeup plan views of two different versions of the display panel of FIG. 1.

FIG. 2 shows the face of one version of a display (and control) panel 26, which is supported (FIG. 1) on a front rail 28 having the general shape of an inverted "U". The hollow rail structure provides passages for electrical wiring connecting the electronic circuitry in the display panel 26 with the circuitry housed in enclosure 24.

The display panel 26 has the dual functions of accepting command options chosen by the user, and providing information to the user during operation of the apparatus.

There are three general options available to the user. The apparatus can be controlled manually, it can select one of several pre-programmed courses, or it can be programmed for interval training. Under manual control the runner can set speed between one and nine miles per hour and adjust track elevation between zero and fifteen percent grade (or from horizontal to an elevation of approximately eight and one half degrees). The pre-programmed courses set speed and elevation automatically. The runner enters the maximum speed, and the program adjusts the speed for each program segment. The eight programs vary in length and maximum grade; Program 1 is the easiest and Program 8 is the hardest. For interval training (or "Laps" mode) the runner programs the speed, elevation, and length of two alternating intervals, plus the number of desired repetitions of both intervals.

In FIG. 2, the primary motivational feature comprises a simulated oval track 30. The preferred method of visually actuating the track is to operate a series of LED elements 32. The number shown, which has been arbitrarily determined, is 48. When the apparatus electronic system is energized, the LED 32*a* is lit. After a given distance has been traveled by the belt 22 (and by the runner), the next LED 32*b*, proceeding in a counter-clockwise direction, is lit, and the first LED 32*a* is turned off. This process continues around the oval track. At any time, the LED which is lit indicates the distance travelled by the runner from the starting position.

The running distance represented by one progression around the track, which also constitutes an arbitrary design determination, is 1/16 mile, or 110 yards. This is one-fourth the length of the usual running track; but the faster visual progress tends to provide a higher level of encouragement to the runner. Sixteen laps around the LED "track" constitute one running mile. Using 48 LEDs in the oval causes the running distance represented by light movement from one LED to the next to be 110/48=approximately 2.3 yards.

Other visual indicators might be used. The lighted elements might be incandescent. A cathode ray tube might be used. Or a moving pictorial symbol might be caused to travel around a track-shaped display. However, the LED display is considered particularly efficient and cost effective.

Another key motivational feature is gradual "filling up" of the oval track as an indication of the percentage of the total program which has been completed. This is accomplished by turning on additional LEDs just behind the leading LED (which represents the runner's position). This provides a series of lighted elements, which move as a string around the track. The length of the string gradually increases until it fills the track, when the pre-selected program is completed. In other words, at the moment of completion, all the LEDs will be turned on. Another way of stating it is to say the "head" of the moving string (or series) of lighted LEDs "chases" its "tail" until the oval is filled with lighted LEDs.

If one of the pre-programmed courses, or protocols, has been selected, the gradual lengthening of the moving string of lights will represent the completed portion of the total pre-programmed course. If the speed has been directly selected by the operator, the display is designed to fill the track with lights when the runner has completed one mile, i.e., sixteen laps. In this situation, 48×16 (768) units of distance would be covered by the LED representing the runner's current position.

Several other display features are shown in FIG. 2. At the right side of the panel, there is a "Program Level" display 34 having eight program level graphical representations, which indicate the relative difficulty of the eight pre-programmed courses, or protocols. Level 1 is the least difficult; level 8 is the most difficult. When the user is inserting commands by pushing the keys located along the bottom of the display panel, any level from 1 to 8 may be selected by pressing one of the keys 1 through 8. Pressing the key designated 0 calls for direct operator selection of speed and elevation. Pressing the key designated 9 calls for insertion of an interval training (or "laps") program.

At the right of program level display 34, LEDs 36 in a vertical column are used to indicate which program level, if any, has been chosen. If one of the pre-programmed course levels has been selected, a single LED will turn on, and remain on, representing the selected level. In actuality, several hundred program courses are available, because the numbers 1 to 9 along the bottom of the display panel permit the operator to select maximum speeds for each of the 8 programs, and the top speeds are variable in increments of 0.1 mph from 1.0 to 9.0 mph.

At the left of program level display 34, LEDs 38 in a vertical column are used to show the "percent grade" of the elevation. If a program is in operation, the LEDs 38 indicate the current elevation of the running platform, i.e., its upward slope from back to front. The display has a "bar graph" effect, in that all LEDs from the bottom up through the current elevation level will remain lighted. If a percent grade is being chosen, the LEDs 38 indicate both the current level, and the direction of change in level. Pushing the key marked "UP ELEV" causes an increase in elevation; pushing the key marked "DN ELEV" causes a decrease in elevation. During elevation changes, the LED toward which the level is moving will provide a flashing signal, while those representing the current level remain on in the "bar graph" display.

The range of percent grades available for selection is from 0 to 15%, i.e., from horizontal to approximately an 8.5° angle of elevation.

If the user wishes to increase or decrease the running speed of the belt, this is accomplished by pushing either the "FAST" key or the "SLOW" key. The speed selections available are from 1 mph to 9 mph.

Pressing the "LAPS" key permits the user to set up an interval training program. The display prompts seriatim for entry of (a) the speed in miles per hour (or the pace in minutes per mile), (b) the angle in percent grade, and (c) the length in laps for each of two different intervals, plus (d) the total number of cycles. To enter a value, the user keys in the appropriate numbers and presses START or LAPS. The program begins after the number of cycles is entered. The following schedule illustrates the procedure of selecting values for an interval training program.

| DISPLAY | VALUE | RANGE |
|---|---|---|
| SPEED 1 | speed of first interval | 1.0–9.0 mph |
| ANGLE 1 | elevation during 1st interval | 0–15% |
| LAPS 1 | length of first interval | 1–99 laps |
| SPEED 2 | speed of second interval | 1.0–9.0 mph |
| ANGLE 2 | elevation during 2nd interval | 0–15% |
| LAPS 2 | length of 2nd interval | 1–99 laps |
| CYCLES | number of repetitions | 1–99 |

The data available in the upper portion 40 of the display panel, above the oval track, includes six digitally indicated items of information, divided into two groups of three items which are concurrently displayed. In one mode, the "elapsed time" (in minutes and seconds), the distance traveled (in miles and decimal fractions thereof), and the current speed (in miles per hour) are simultaneously displayed. In the other mode, the calories/hour, total calories, and pace (in minutes and seconds per mile) are simultaneously displayed. Switching between the two modes is caused by pushing the key "NEXT". The caloric calculation is based on an assumed average weight, and is not adjusted for weight differences.

Figure 3:
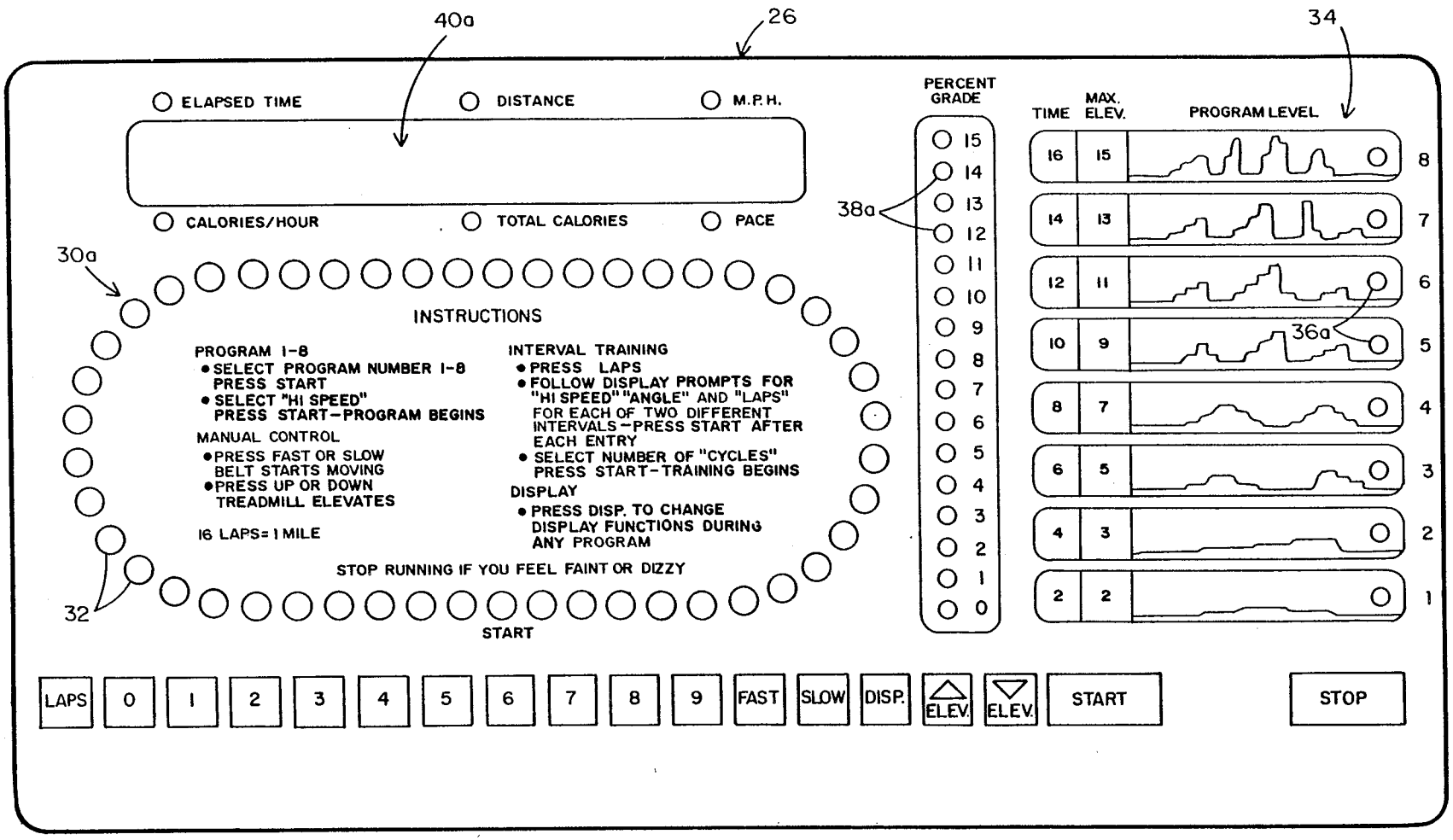

FIG. 3 shows a modified version of the display/command panel which is intended for use primarily by exercise clubs and organizations who provide "fitness" facilities. Its primary difference from the display/command panel of FIG. 2 is that the 8 pre-programmed courses displayed at the right of the panel are set for varying total time periods, rather than for varying total distances. This is indicated by the heading "Time", under which the respective numerals represent total time of each course in minutes. The range shown varies from 2 minutes to 16 minutes.

The oval track 30*a* having 48 LEDs, the LEDs 36*a*, which display the selected one of the 8 courses, the LEDs 38*a* associated with "percent grade", the user-operated command keys along the bottom of the display, and the digital display 40*a* in the upper left, are all substantially the same as similar elements in FIG. 2. In FIG. 3 the operating instructions are shown on the face of the display, for user convenience. This is particularly desirable where a large number of different users are involved.

Figure 4:
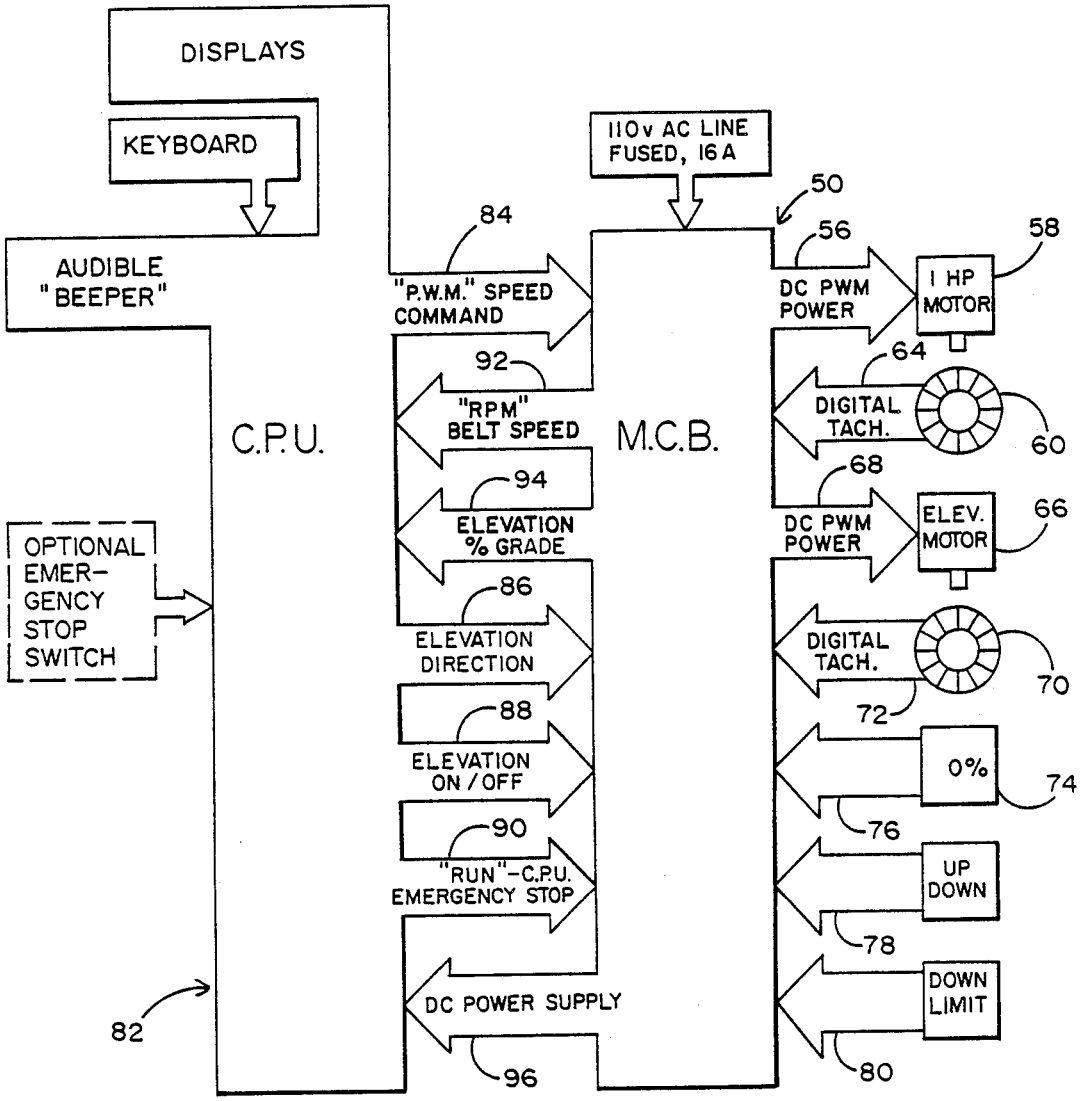
FIG. 4 is a block diagram showing the general relationship of the operating system components.

FIG. 4 is a block diagram showing, in a very general way, the operating system components and their interrelationships. A motor control board (MCB) 50 contains the motor driving and speed control circuitry. It receives power from a standard AC line via a power switch and circuit breaker (not shown). It provides driving power via electrical connection 56 to a DC motor 58 which drives the moving belt. The driving power to the motor is provided by an SCR (silicon controlled rectifier) power system, whose duty cycles are controlled by a pulse width modulated (PWM) signal.

The speed of motor 58 determines the running speed of the user. An encoder disk 60, which rotates with the shaft of motor 58, constitutes an optical speed sensor, whose data is transmitted as a digital pulse frequency by an optical shaft encoder, or digital tachometer. A feedback line 64 carries the speed sensor information to the motor control board 50, where it is utilized in an automatic motor speed control circuit. Power is supplied to the shaft encoder 62 from the motor control board 50.

A separate, direction-reversible motor 66 causes raising and lowering of the front end by means of the lead screw/nut elevation mechanism. Power is supplied to motor 66 from control board 50 via line 68. This power is also controlled by a PWM signal. The revolutions of motor 66 are sensed by an optical digital sensor 70, which provides elevation feedback information via line 72 to the motor control board 50. Because this sensor can only measure a travel deviation from horizontal, the motor will automatically return to zero elevation when the system is reactivated after power disconnect. This return to 0% elevation is determined by a sensor (micro-switch) 74 which sends its feedback via line 76. As a safety feature, the elevation motor is arranged to be automatically turned off by either an "UP LIMIT" switch 78 or a "DN LIMIT" switch 80, if it tries to move beyond its highest or lowest acceptable levels.

A micro-computer board (CPU) 82 is combined with the display panel. It receives the user's selection inputs from the keyboard, outputs command instructions to the motor control board 50, and computes the data required for operation of the display panel. The command output lines are PWM speed control line 84, elevation direction control line 86, elevation on/off line 88, and emergency stop line 90. Feedback to the CPU is provided by line 92, which carries the encoder data representing the speed of motor 58, and by line 94, which carries the data indicating the position of the elevation mechanism. A power supply line 96 connects control board 50 to CPU 78.

Because of the fact that the exercise system disclosed in this application is driven at a speed automatically established by the program, rather than a speed established by the operator's effort (as in cycles and rowing machines), the user can be thrown off the belt and injured if, for any reason, speed tends to accelerate too rapidly. In other words, if the speed control system erroneously "thinks" that it should accelerate, it will continue to call for faster operation.

A plurality of safety features have been combined to prevent such an occurrence. These safety features, and the automatic motor speed control system, are described in detail, and claimed, in a separate application Ser. No. 913,327, filed Sept. 30, 1986 which is also assigned to the assignee of this application.

FIG. 4 indicates (arrows 56 and 68) that the motor driving power supplied by MCB 50 to both the belt drive motor 58 and the elevation motor 66 is in the form of DC pulse width modulated (duty cycle varied) power.

Figure 5:
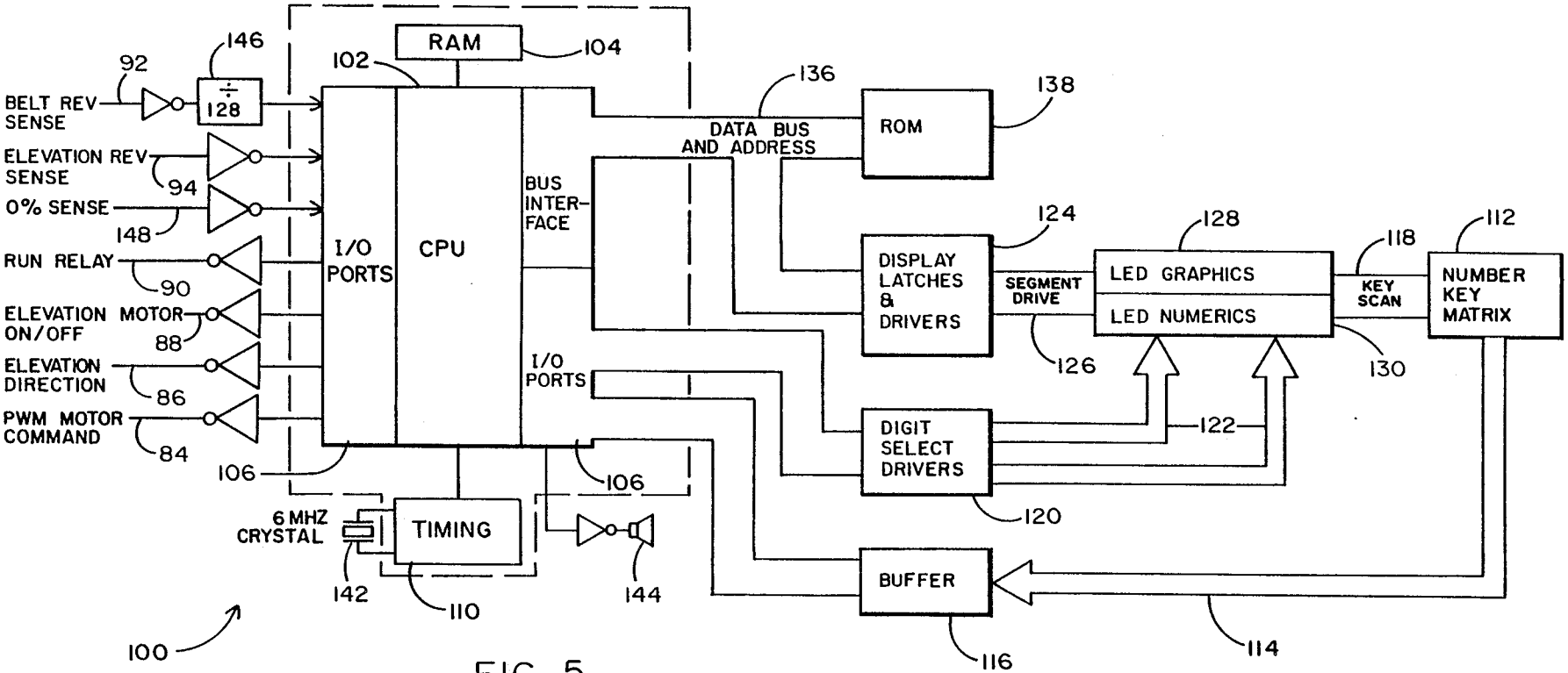
FIG. 5 is a block diagram showing the electronic components in the display panel.

FIG. 5 is a block diagram showing the functional relationship of electronic components in the display board. A microprocessor 100 comprises a CPU segment 102, a random access memory (RAM) segment 104, input/output ports 106, bus interface 108, and a timing segment 110, all of which are on a chip, as indicated by the dashed boundary line.

The numerical keys provided for user control are associated with a key matrix 112, which has a row/- column selection of 18 intersection (3×6). As shown, 3 rows are carried by leads 114 from matrix 112, through a buffer 116, to 3 input ports of the CPU. A key scan function 118 provides 6 columns intersecting the 3 lines to provide an 18 point matrix. Digit select drivers 120 drive one column at a time through lines 122 and key scan 118. Buffering between the display board and the CPU is required because of voltage level shifting. The display uses 5 V DC, and the CPU uses 10 V DC to actuate the LEDs. Pressing a key connects a row to a column in the key matrix, which is sensed by one of the three buffered input ports. The activated column is under CPU control; so the key is identified.

Control signals from the CPU are transmitted to the LED graphics and numerical display through "display latches and drivers" circuitry 124 via segment drive 126, and through the "digit select drivers" dircuitry 120. In the figure, "LED graphics" are symbolized by a block 128, and "LED numerics" by a block 130. The number of digits required by the numerics display is 11; and the number of digits required by the graphics display is 9. The graphics require 9 8-segment digits, 6 of which drive the oval track display. By combining the 11th digit in the numerics display with the 9 digits in the graphics display, LED refresh signals can be simultaneously sent to a pair of digits by the 10 digit drive connection 122. Each LED is turned off once per millisecond, and remains off for a few microseconds to avoid "ghosting". The 10 digit pairs are multiplexed, each LED being available for about 8% of the time. This is adequate for visual clarity, because of image retention by the viewer. Even though a given LED is made available by the multiplexing drive signals, it will not light up unless caused to do so by a signal from the latches and drivers circuitry 124 passing through the "segment drive" 126. In other words, the segment drive 134 determines which LEDs are turned on within a given digit.

A data bus and address 136 permits the CPU segment 102 to access a ROM 138 (which provides the operating program memory), and to control the latches and drivers circuitry 124. The latter is fed by 8 bus lines and 8 address lines.

The timing system 110 having a 6 MHz crystal 142 provides the clock signal for CPU segment 102. A small speaker 144 controlled by the CPU is used to create a series of "beeps" at the end of the program, when a key is pressed, and when speed or elevation is about to change.

The signal inputs and outputs shown at the left side of microprocessor 100 comprise three feedback sensor inputs and four operation control outputs, all but one of which were previously identified in FIG. 4. The digital encoder sensor provides a belt speed-indicating input signal on line 92. This is a pulse train, whose frequency varies with motor speed. The frequency signal into the CPU is reduced to permit easier CPU response by means of a divider 146. The block shows division by 128; experience with the apparatus has indicated that division by 64 might be preferable.

Two sensor inputs are sent to the CPU from the elevation mechanism. A signal on line 94 indicates elevation grade, by a pulse train having one pulse per motor revolution. A signal on line 148 is provided by a microswitch which opens to indicate that the elevation is 0%, i.e., that the belt is in its horizontal position.

The CPU has four command output lines which lead to MCB 50 (FIG. 4). These command signals feed into the circuitry on the MCB which separately controls the belt driving motor and the elevation control motor. A detailed description of the motor control circuitry is included in copending, common-assignee application Ser. No. 913,327.

The command signal from CPU to MCB on line 84 is a pulse width modulated (PWM) speed command. This is based on the data stored in one of the memory units. The command signal from CPU to MCB on line 86 is an elevation direction command (up or down) which determines the direction of rotation of the elevation drive motor. The command signal from CPU to MCB on line 88 causes the elevation motor to turn on or off. The command signal on line 90 is an "emergency stop" command, which operates a relay switch to cause power to shut off at both the belt drive and elevation drive motors. This is an important safety feature, which is discussed and claimed in Ser. No. 913,327.

Figure 7:
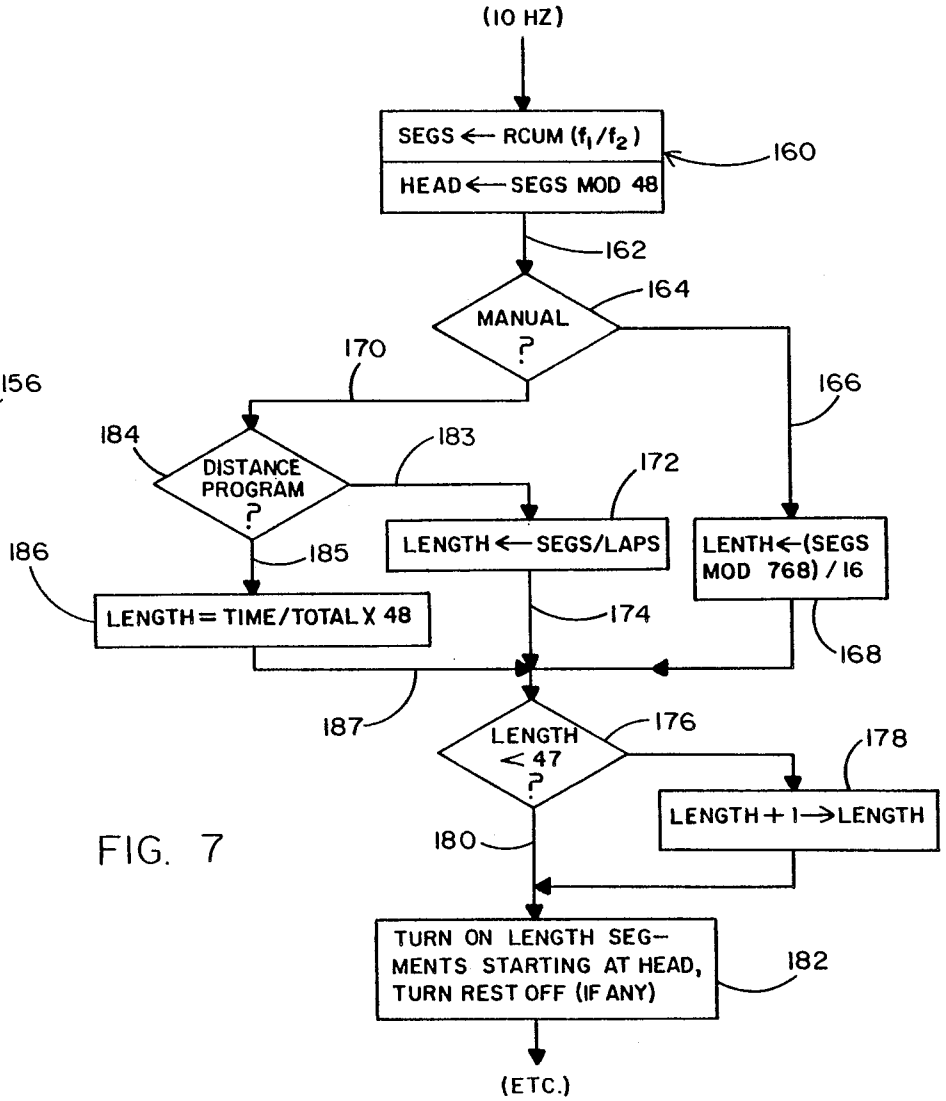
FIGS. 6 and 7 are flow charts showing, respectively, a logic routine which compares distance traveled and elapsed time, and a logic routine which determines which LEDs on the oval track should be turned on, and which should be turned off, at each segment of user travel.
Figure 6:
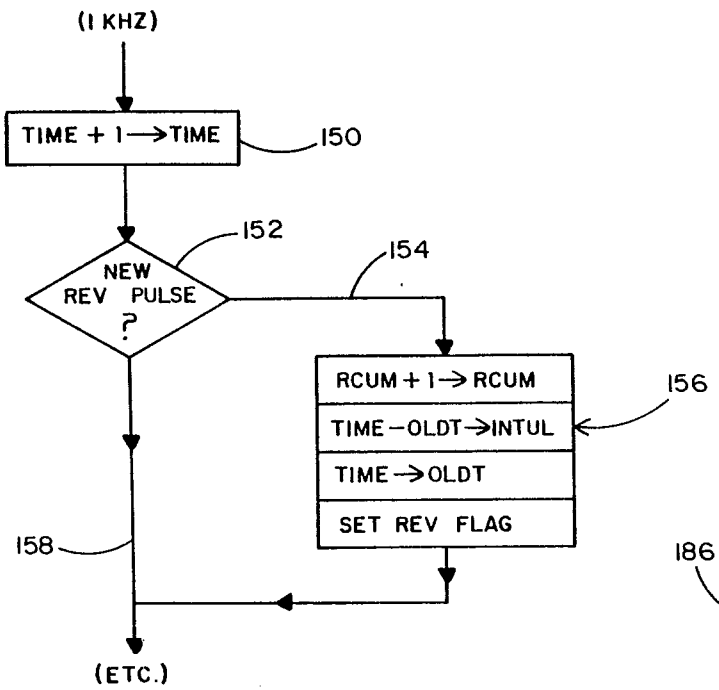

FIGS. 6 and 7 are flow charts used to illustrate the track display logic under CPU control. FIG. 6 shows a 1 KHz interrupt service routine, beginning with a 1 KHz clock input. The time information in the system is determined by counting clock pulses. A process block 150 sets previous time plus one unit of time as current time. Then a decision, or branch, block 152 determines whether a new motor revolution pulse has come from the encoder disk which senses the motion of the belt drive motor. If the answer is positive, the control flow moves along line 154 to process block 156, in which four actions are accomplished. The cumulative count of revolution pulses is increased by one to set the new count. The new time minus the previous time is calculated to determine the interval, or period, between motor pulses. The new time is reset to appear as the previous time during the next loop. And the revolution flag is set. Either a negative answer at decision block 152, or completion at process block 156 causes control flow to move along line 158 to exit.

FIG. 7 shows the main track control logic routine, which is executed ten times per second (10 Hz). The distance (pulse) count is converted to a segment count, each segment representing the distance traveled in moving from one track LED to the next track LED. Also, the LED which is at the head of the string, i.e., the LED representing the current position of the user on the track, is determined as segments modulus 48, i.e., as the remainder in the number of segments traveled, after the total number of segments traveled has been divided by 48 (the number of LEDs in the track).

Flow line 162 leads to decision block 164, which checks whether the apparatus is under manual control. If it is, flow line 166 leads to process block 168, which calculates the percentage of completion of one mile, i.e., one mile (constituting 768 segments) is used as the modulus. The percentage of completion determines the length of the string of lighted LEDs.

The software flow chart of FIG. 7 is useable for either the display of FIG. 2 or the display of FIG. 3. If the apparatus is not under manual control, the next decision is whether a total distance program, as displayed in FIG. 2, or a total time program, as displayed in FIG. 3, is in effect. This question is answered by a decision block 184, to which is input a negative flow line 170 from block 164.

If the distance program is in effect, flow line 183 leads to process block 172. At this point the length of the LED lighted string is determined by dividing the number of segments completed by the total number of laps in the preprogrammed course. For example, if 8 laps are programmed, and 96 segments have been completed, the length of the LED lighted string will be 96/8=12 LEDs; one fourth (2 laps) of the program has been completed. After four laps, half the track (24 LEDs) will remain lighted; after 6 laps, three-fourths of the track (36 LEDs) will remain lighted.

After length determination, flow line 174 leads to decision block 176. As long as the length of the string is under 47 LEDs, a correction is made at process block 178 to compensate for the fact that the original runner-representing LED does not represent a segment of movement. This correction is discontinued when the string length reaches 47 LEDs.

Line 180 leads to process block 182. This block sends signals to be temporarily stored in memory (RAM), using high for "on" segments and low for "off" segments. It instructs the display electronics to turn on segments, starting at the appropriate head position, and having the appropriate string length; it instructs the display electronics to turn off all other segments. The information items symbolized as "TIME", "RCUM", "INTVL", "OLDT", "SEGS" and "HEAD" are variables in the memory. "LENGTH" symbolizes a temporary register value.

If decision block 184 indicates that a distance-determined program is not in effect, then a time-determined program is in effect. Negative line 185 leads to process block 186, in which the length of the LED lighted string is determined by dividing the elapsed time by the product of 48 and the total program time. Line 187 then leads to decision block 176.

From the foregoing description, it will be apparent that the apparatus disclosed in this application will provide the significant functional benefits summarized in the introductory portion of the specification.

The following claims are intended not only to cover the specific embodiments disclosed, but also to cover the inventive concepts explained herein with the maximum breadth and comprehensiveness permitted by the prior art.

What is claimed is:

1. In an exercise apparatus having a moving surface for running or walking, a motor for driving the moving surface, and means for varying the motor speed; a control and display system comprising:

user-operated command means for selecting desired motor speeds;

an electronic processor for storing the commands and causing them to control the motor-speed-varying means;

sensor/feedback means for conveying to the electronic processor information as to the distance represented by the motion of the moving surface;

a visual display including: (a) a closed course, the length of which represents a given distance; and (b) a position-indicating means which travels along the course repeatedly; and means under the control of the electronic processor for causing the position-indicating means to travel continuously and repetitiously along the course as a function of the distance represented by the motion of the moving surface, in order to pictorally inform the user as to the distance covered.

2. The system of claim 1 in which the display closed course is an oval-shaped loop which simulates the shape of a running track.

3. The system of claim 1 in which the closed course is composed of a multiplicity of individual lights which are turned on and off under control of the electronic processor;

the turned on light being selected by the electronic processor to represent the user's current position on the track; and the progression from one "on" light to the next "on" light representing a given travel distance.

4. The system of claim 3 wherein the distance represented by moving of the turned on light around the course is a fraction of one mile, thus equating to a running mile a given number of completions of the light-to-light movement around the course.

5. The system of claim 4 which also comprises:

means under the control of the electronic processor for causing the course to gradually fill up with turned on lights as a function of the percentage of completion of a given distance, in order to pictorally inform the user of progress toward a distance-measured goal.

6. The system of claim 5 wherein the course fills up with turned on lights when the user has run one mile.

7. The system of claim 3 which also comprises:

means under the control of the electronic processor for causing the course to gradually fill up with turned on lights as a function of the percentage of completion of a given amount of user exercise, in order to pictorially inform the user of progress toward a preselected goal.

8. The system of claim 1 in which the user-operated command means permits pre-selection of an automatically operable program having a pre-determined amount of user exercise.

9. The system of claim 8 which also comprises:

means under the control of the electronic processor for causing the position-indicating means to gradually fill up the course as a function of the percentage of completion of the pre-selected program, in order to pictorially inform the user of progress toward a program completion.

10. The system of claim 1 which also comprises:

means under the control of the electronic processor for causing the position-indicating means to gradually fill up the course as a function of the percentage of completion of a given amount of user exercise, in order to pictorially inform the user of progress toward a preselected goal.

11. In an exercise apparatus having a moving surface for running or walking:

a first motor for driving the moving surface;

speed-varying means for controlling the speed of the first motor and thus the speed of the moving surface;

a second motor for causing variations in the inclination of the moving surface with respect to the horizontal;

position-controlling means for varying the amount of inclination caused by the second motor;

user-operated command means for selecting desired speeds of the first motor and desired elevations to be attained by the second motor, said command means having options including programmed automatic variations in both the speed attained by the first motor and the elevation attained by the second motor;

an electronic processor for storing the user commands and causing them to control the first and second motors at appropriate times;

first sensor/feedback means for conveying to the electronic processor information as to the speed of the first motor;

second sensor/feedback means for conveying to the electronic processor information as to the amount of elevation attained by the second motor; and display means, which is controlled by the electronic processor in response to the second sensor/feedback means, and which includes a vertical column of lights which are turned on in a bar graph display, the level of which represents the current inclination of the moving surface.

12. In an exercise apparatus having a moving surface for running or walking:

a first motor for driving the moving surface;

speed-varying means for controlling the speed of the first motor and thus the speed of the moving surface;

a second motor for causing variations in the inclination of the moving surface with respect to the horizontal;

position-controlling means for varying the amount of inclination caused by the second motor;

user-operated command means for selecting desired speeds of the first motor and desired elevations to be attained by the second motor, said command means having options including programmed automatic variations in both the speed attained by the first motor and the elevation attained by the second motor;

an electronic processor for storing the user commands and causing them to control the first and second motors at appropriate times;

first sensor/feedback means for conveying to the electronic processor information as to the speed of the first motor;

second sensor/feedback means for conveying to the electronic processor information as to the amount of elevation attained by the second motor;

a display having a plurality of vertically-separated rows providing graphic representations of the relative difficulty in the programmed options, in which graphic differences symbolize both the variations of difficulty within each option, and the differences in difficulty between different options;

the rows being arranged in ascending order of increasing difficulty.

13. The exercise apparatus of claim 12 which also comprises:

indicating means adjacent the display for indicating during operation which option has been selected.

14. The exercise apparatus of claim 12 in which the indicating means comprises:

a column of lights, each light aligned with a different row; and means for causing the light aligned with the row representing the selected option to remain on during operation.

15. In an exercise apparatus having a moving surface for running or walking:

a first motor for driving the moving surface;

speed-varying means for controlling the speed of the first motor and thus the speed of the moving surface;

a second motor for causing variations in the inclination of the moving surface with respect to the horizontal;

position-controlling means for varying the amount of inclination caused by the second motor;

user-operated command means for selecting desired speeds of the first motor and desired elevations to be attained by the second motor, said command means having options including programmed automatic variations in both the speed attained by the first motor and the elevation attained by the second motor;

an electronic processor for storing the user commands and causing them to control the first and second motors at appropriate times;

first sensor/feedback means for conveying to the electronic processor information as to the speed of the first motor;

second sensor/feedback means for conveying to the electronic processor information as to the amount of elevation attained by the second motor;

means controlled by the electronic processor for visually displaying information representing the speed of the moving surface; and means controlled by the electronic processor for visually displaying information representing the inclination of the moving surface.

16. In an exercise apparatus having a movable structure whose motion is proportional to the amount of exercise performed by the user of the apparatus, a display system comprising:

an electronic processor for providing a visual display for the user's information;

feedback means for conveying from the movable structure to the electronic processor information concerning the amount of exercise performed by the user;

a visual display member having the form of a closed course;

position-indicating means adapted to travel along the length of the closed course and to continuously repeat such travel in successive trips through the course; and control means, associated with the electronic processor, which, in response to information from the feedback means, causes the position-indicating means to travel along the closed course at a rate proportional to the rate at which exercise is performed by the user, and causes the position-indicating means to complete a number of successive trips through the course proportional to the total exercise performed by the user.

17. The apparatus of claim 16 which also comprises:

means for user pre-selection of the total intended exercise in a continuous program; and means for displaying on the course progressively changing percentages of completion of the total pre-selected user exercise program.

18. An exercise apparatus in which the amount of exercise is visually represented for the user's information, comprising:

a display having a closed course on which the user's progress is shown, the course being so arranged that the user, without stopping, begins to traverse it again immediately after completing it, and repeats the course throughout the exercise period;

indicating means which advances along the course to indicate the user's progress;

means for determining the amount of exercise being performed by the user; and position control means responsive to the determining means, for causing the indicating means to advance along the course at a rate determined by the rate of user performed exercise.

19. The exercise apparatus of claim 18 in which the indicating means comprises a series of lighting segments which are turned on seriatim to display the advancing position of the user.

20. The exercise apparatus of claim 19 which also comprises:

means for user pre-selection of the total intended exercise in a continuous program; and means for displaying on the course progressively changing percentages of completion of the total pre-selected user exercise program;

said means for displaying the changing percentages of completion including means for turning on additional lighting segments behind the one which displays the user's position, the number of such turned on lighting segments representing the percentage of completion of the total pre-selected user exercise program.

* * * * *